US005944144A

United States Patent [19]

Hein

[11] Patent Number: 5,944,144

[45] Date of Patent: Aug. 31, 1999

[54] TRACTION DRIVE ELEVATOR

[76] Inventor: Wilfried Hein, Bremer Str. 3a, 33613 Bielefeld, Germany

[21] Appl. No.: 08/948,634

[22] Filed: Oct. 10, 1997

[51] Int. Cl.[6] ..... B66B 11/08

[52] U.S. Cl. ..... 187/254; 187/270; 187/410

[58] Field of Search ..... 187/254, 256, 187/258, 249, 270, 404, 410, 414

[56] References Cited

U.S. PATENT DOCUMENTS 3,924,710 12/1975 Shohet ..... 187/270
5,490,579 2/1996 Ratcliffe et al. ..... 187/254

*Primary Examiner*—Kenneth W. Noland
*Attorney, Agent, or Firm*—White & Case L.L.P.

[57] ABSTRACT

A traction drive elevator system preferably comprises a pair of vertical tracks, a car, and at least one counterweight for supporting at least a portion of the weight of the car. A traction drive, which preferably includes a frame which is separate from the car, comprises two sets of drives, each including a large traction roller and a pair of smaller diameter counter rollers which are disposed on opposite sides of one of the tracks. The axis of the traction roller is horizontal preferably at a height midway between the axes of the counter rollers, and the counter rollers are moveable in a direction toward the track. Means, preferably an eccentric mounting in combination with a gas spring, urge the counter rollers towards the track, thereby creating friction between the rollers and the track. A motor and gear box, which preferably includes a worm and spur gear combination, selectively rotate the traction rollers for moving the car between landings. Finally, a safety bar maintains traction between the wheels and the track in the event the gas spring fails. Preferably, the tracks constitute one of two inwardly projecting tracks of a rail which is U-shape in cross-section. The counter rollers are located in the U-shaped trough, and the traction roller is located to the outside of the rail and therefore can be made of substantially larger diameter. The other track is used to guide the counterweight.

11 Claims, 6 Drawing Sheets

TRACTION DRIVE ELEVATOR

BACKGROUND OF THE INVENTION

1. Field of the Invention

The invention relates to elevators, such as passenger and freight elevators, that operate between two or more floors or landings.

2. Description of Related Art

There are two types of modern elevators, traction elevators and hydraulic elevators. In traction-type elevators, an elevator car is suspended by a wire rope, usually in a hoistway. The rope extends upwardly to the top of the elevator shaft, is directed around an overhead drive pulley, passes over a guide pulley, and thereafter extends downwardly to a counterweight. A motor is coupled to the drive pulley, either directly (a so-called "gearless elevator") or through intermediate gears (a so-called "geared elevator"), such that actuation of the motor selectively raises and lowers the car between floors.

In hydraulic elevators, the weight of the car is supported by one or more hydraulic jacks. In order to raise the car, a motor pumps hydraulic fluid from a reservoir through a control valve into the jacks. To lower the car, the valve is opened to vent the jack, and the weight of the car causes fluid to flow out of the jack and back into the reservoir, and thereby allows the car to descend.

Traction elevators can be designed to operate over a broad range of speeds, depending upon the intended application, and can serve buildings ranging from two stories to skyscrapers. The principal drawbacks of traction elevators are their relatively high cost and the fact that they generally require an overhead penthouse, in order to house the pulleys and motor/drive system. Hydraulic elevators are less costly, but are not capable of operating as fast as traction elevators, and the number of floors that can be serviced is limited.

My prior U.S. Pat. No. 5,572,530 discloses an elevator system in which the car moves up and down using a traction drive instead of an overhead motor and pulley or a hydraulic cylinder. A pair of rollers, which are mounted on a swivel plate, are disposed on either side of a rail and pressed towards the rail to create friction. A motor, which is on the elevator car, drives at least one of the rollers to move the elevator car up or down. Such elevator has the advantages of a traction elevator, in terms of high speed capability and the potential to service high rise buildings, but does not require an overhead penthouse supporting a motor and drive system as in conventional traction elevators.

SUMMARY OF THE INVENTION

A traction drive elevator system preferably comprises a pair of vertical tracks, a car, and at least one counterweight for supporting at least a portion of the weight of the car. A traction drive, which preferably includes a frame which is separate from the car, comprises two sets of drives, each including a large traction roller and a pair of smaller diameter counter rollers which are disposed on opposite sides of one of the tracks. The axis of the traction roller is horizontal and parallel to the axes of the counter rollers. The traction roller is spaced vertically between, preferably at the vertical midpoint of, the counter rollers, and the counter rollers are moveable in a direction toward the track. Means, preferably an eccentric mounting in combination with a gas spring, urge the counter rollers towards the track, thereby creating friction between the rollers and the track. A motor and gear box, which preferably includes a worm and spur gear combination, selectively rotate the traction rollers for moving the car between landings. Finally, a safety bar maintains traction between the wheels and the track in the event the gas spring fails.

Preferably, the tracks constitute one of two inwardly projecting tracks of a rail which is U-shape in cross-section. The counter rollers are located in the U-shaped trough, and the traction roller is located to the outside of the rail and therefore can be made of substantially larger diameter. The other track is used to guide the counterweight.

For a better understanding of the invention, reference is made to the following detailed description of a preferred embodiment, taken in conjunction with the drawings accompanying the application. BRIEF DESCRIPTION OF THE DRAWINGS FIG. 1 is a side view of an elevator system according to the invention, with the near side wall of the elevator shaft omitted for clarity;

DESCRIPTION OF PREFERRED EMBODIMENTS

Figure 1:
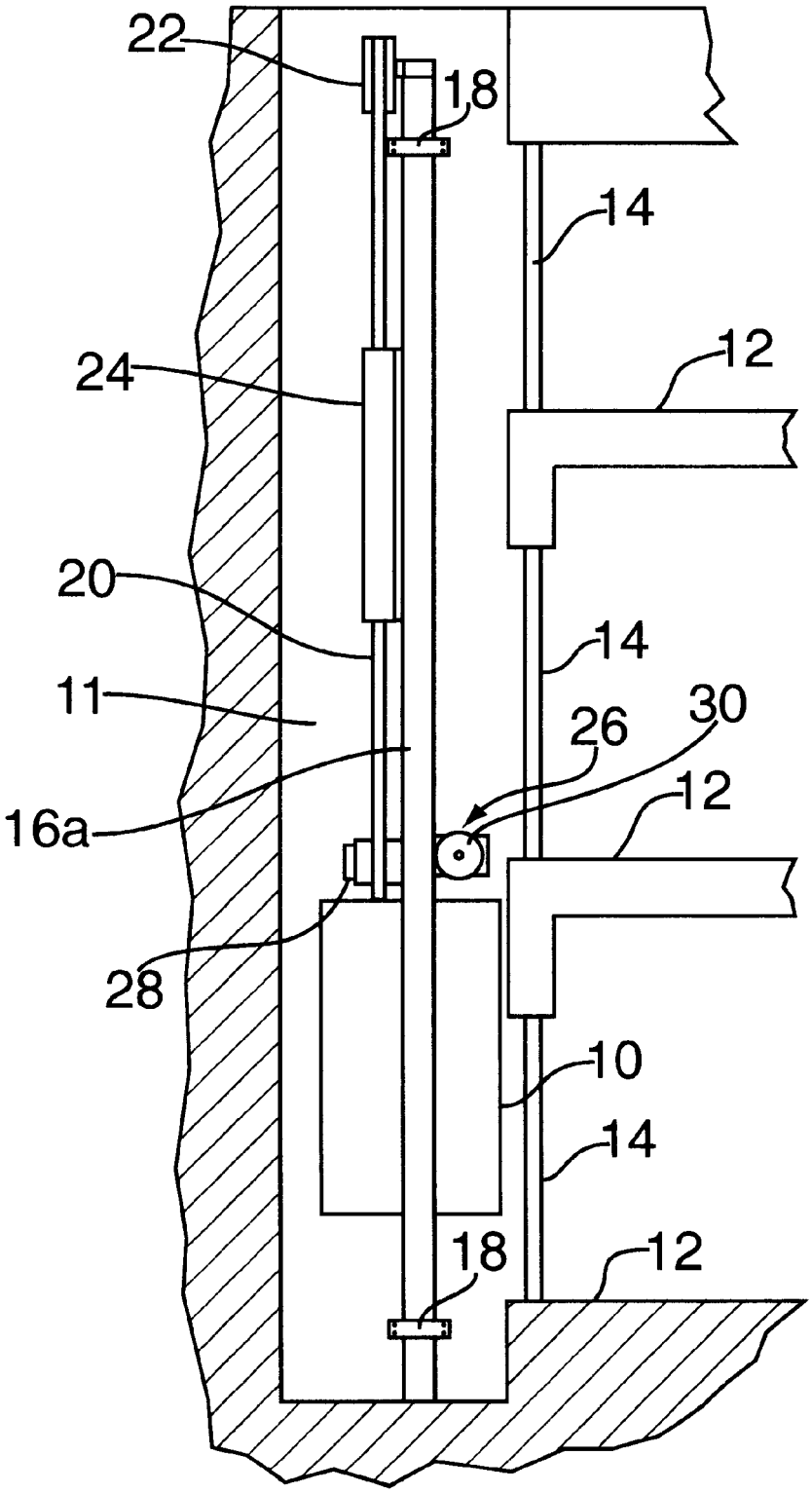

FIG. 1 shows an elevator system including a car 10 moveable in a shaft 11 between a plurality of landings 12, each landing having a conventional hatchway door 14. A pair of vertical rails, one of which 16*a,* is visible in FIG. 1, are supported by the pit floor, and are secured to the opposing shaft walls (the shaft wall on which rail 16*a* is mounted being omitted for clarity) using mounting brackets 18. A pair of ropes, one of which 20 can be seen in FIG. 1, each have one end connected to the car 10, and extend around overhead pulleys 22 to a pair of counterweights 24 to support the weight of the car 10. Finally, FIG. 1 shows one of two traction drives 26, each of which includes a motor 28 and drive wheel 30. The traction drives 26 are described in greater detail below.

Figure 2:
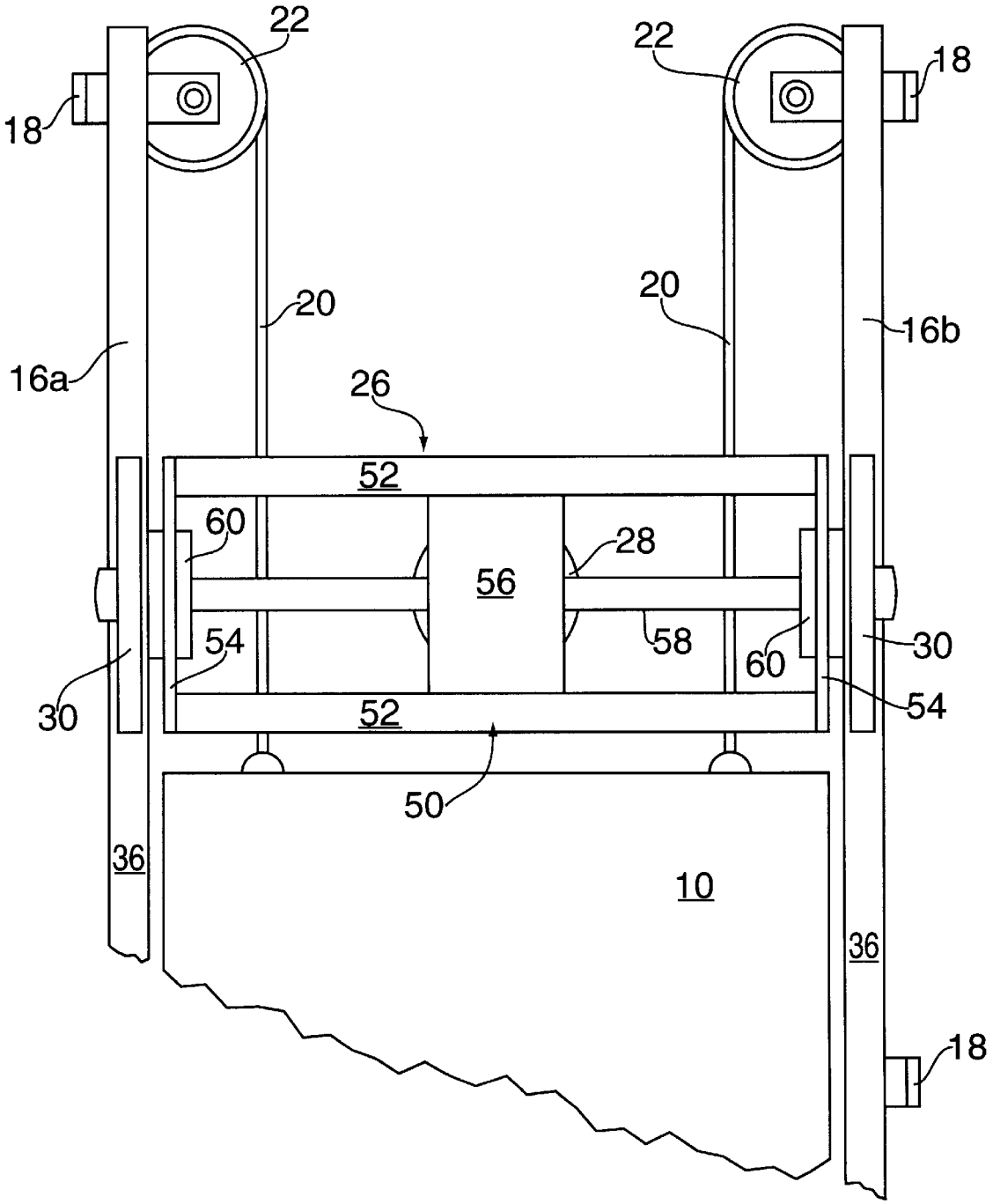
FIGS. 2 and 3 are front and top views, respectively, of the elevator system minus the elevator shaft.
Figure 3:
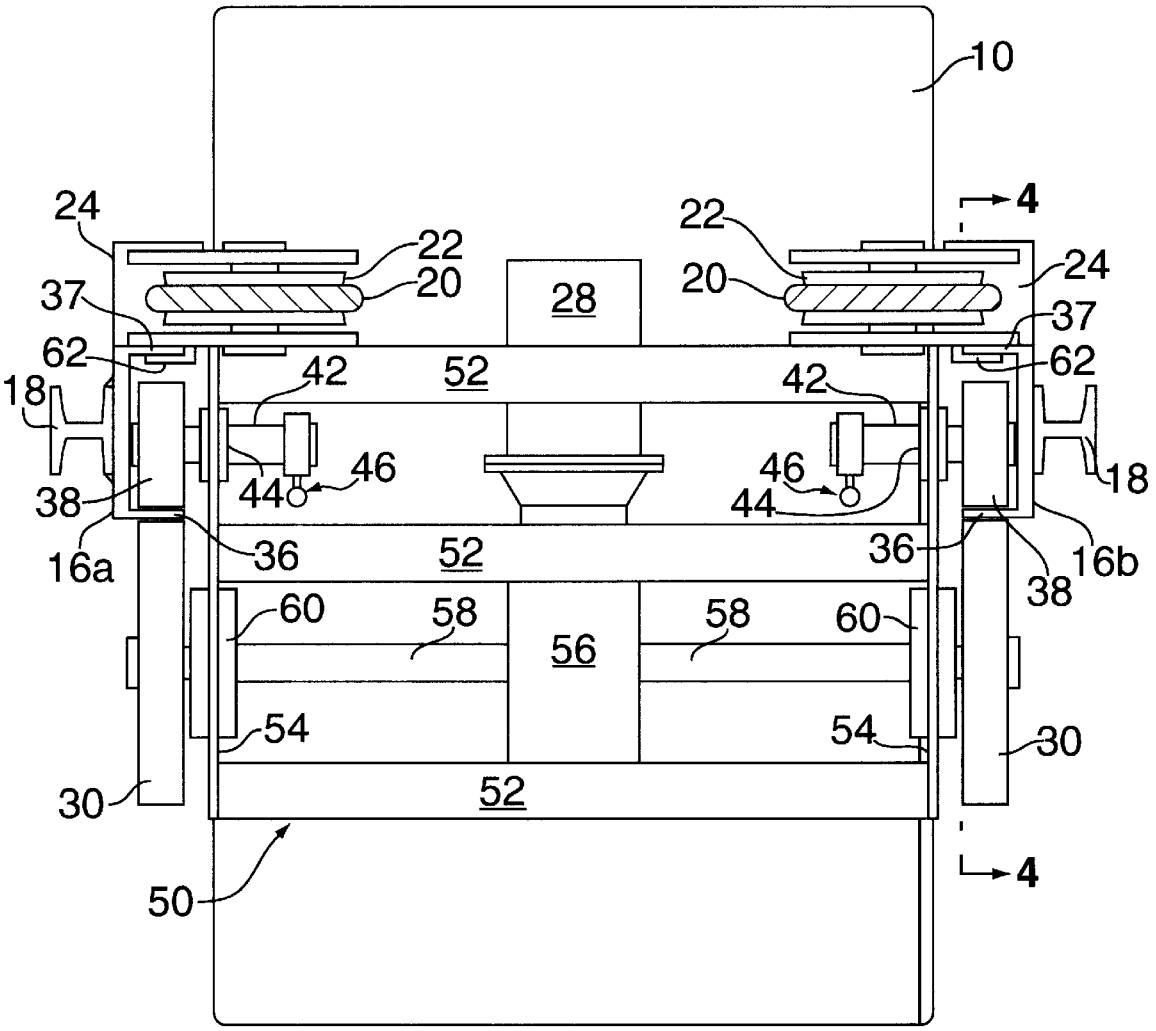
Figure 4:
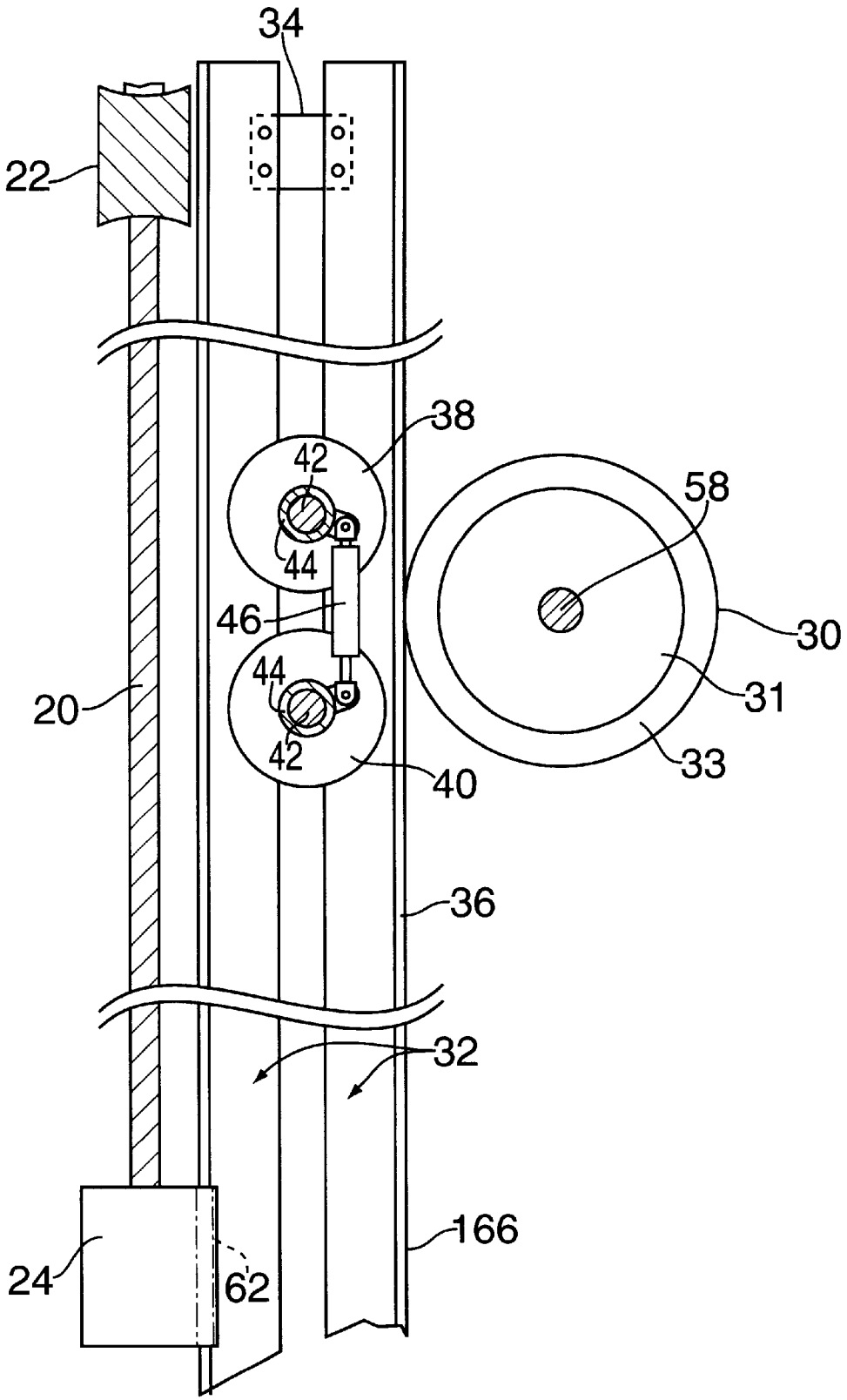
FIG. 4 is a side view, taken in the direction of arrows 4—4 of FIG. 3.

Referring now to FIGS. 2–4, each of the rails 16*a,* 16*b* is in the shape of an inwardly facing, U-shaped profile, so as to define a pair of parallel, inwardly directed tracks 36, 37. As shown in FIG. 4, the U-shaped profile can be formed by connecting two right angle sections 32, e.g., using brackets 34. Alternatively, a single U-shaped rail can be used. Preferably the rails 16*a,* 16*b* are machined or cold pulled, in order that a conventional safety (not shown) can be used.

The traction drive 26 is preferably a self-contained unit, containing a frame 50 formed by various cross-members 52 and end plates 54. In this manner, the traction drive 26 can be manufactured separate from the car 10. The motor 28, which is supported by the frame 50, is coupled to a gear box 56. A drive shaft 58 extends from the gear box 56 in either direction, through bearings 60 supported in each end plate 54, and is coupled at either end to the traction wheels 30.

Each traction drive 26 also includes two pairs of counter rollers 38, 40. Each counter roller 38, 40 is rotatably mounted on a shaft 42 which is supported in eccentric mountings 44, as described further below. A gas spring mechanism 46, operating between the counter rollers 38, 40 of each pair, causes the eccentrics to urge the counter rollers 38, 40 toward the traction roller 30.

The axes of the counter rollers 38, 40 are located above and below, respectively, the axis of rotation of the traction roller 30. Preferably, the axis of the traction roller 30 is vertically midway between the two axes of the two counter rollers 38, 40. In this manner, when the counter rollers 38, 40 are urged towards the track 36 (as described below), the rollers will press against the track 36 without creating torque about their horizontal axes.

The traction wheel 30 and the counter rollers 38, 40 of each pair are disposed on opposite sides of the track 36, and the force of the gas spring 46, pressing the traction 30 wheel towards the corresponding counter rollers 38, 40 causes the wheels 30, 38, 40 to bear against the track 36 and create friction between the traction wheel and the track 36.

Referring to FIG. 4, each drive roller 30 includes a metal hub 31 whose outer surface is covered by an annular ring 33 made of a plastic material such as polyurethane, which is bonded to the metal surface of the hub 31 for increasing the coefficient of friction of the surface of the roller 30 which is in contact with the track 36. If desired, the mating surface of the track 36 may be roughened in order to increase its frictional value as well.

The two counterweight pulleys 22 are supported respectively at the top of the two rails 16*a*, 16*b*, such each counterweight rope 20 extends over one of the pulleys 22 and downwardly to its respective counterweight 24 (see FIGS. 3 and 4). Each counterweight includes a guide 62 (see FIGS. 3 and 4) which engages the other track 37 of the U-shaped rails 16*a*, 16*b*.

Figure 5:
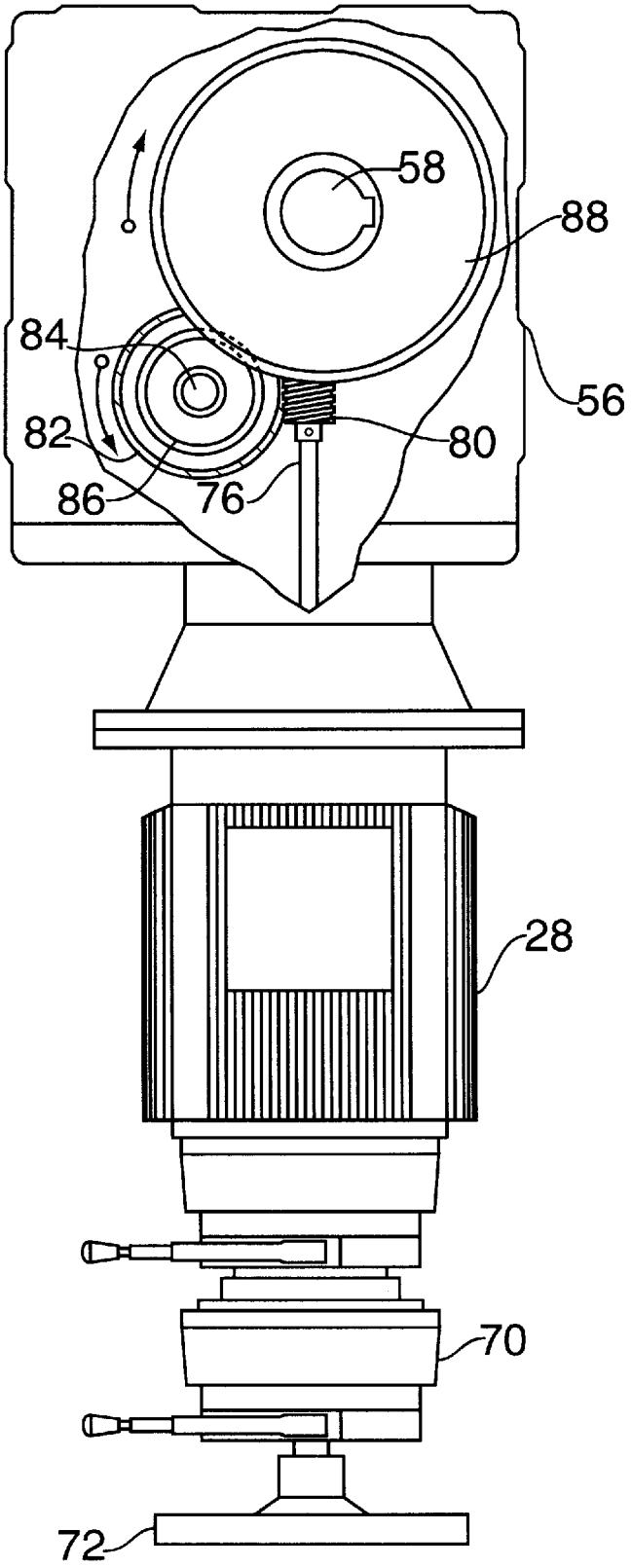
FIG. 5 is a front view of the motor and gearbox.

As shown in FIG. 5, which shows the motor/drive assembly in greater detail, the motor 28 can be connected to an integral brake 70, and a hand crank 72 can be provided for manually lowering or raising the car 10 in emergencies. The output shaft of the motor 28 is coupled to a gearbox shaft 76 on which is mounted a worm 80. The worm 80 is geared to a worm wheel 82, which is mounted on a common shaft 84 with a pinion gear 86 for rotation therewith. Preferably, the pinion gear 86 has a diameter which is smaller than the worm wheel 84. The pinion gear, in turn, meshes with a spur gear 88 of substantially larger diameter, which drives the shaft 58 coupled to the traction wheels 30. The combination of a worm and spur gear assembly allows the motor output shaft to be geared down to the desired speed for driving the traction rollers 30 in a very efficient and quiet manner.

Figure 6:
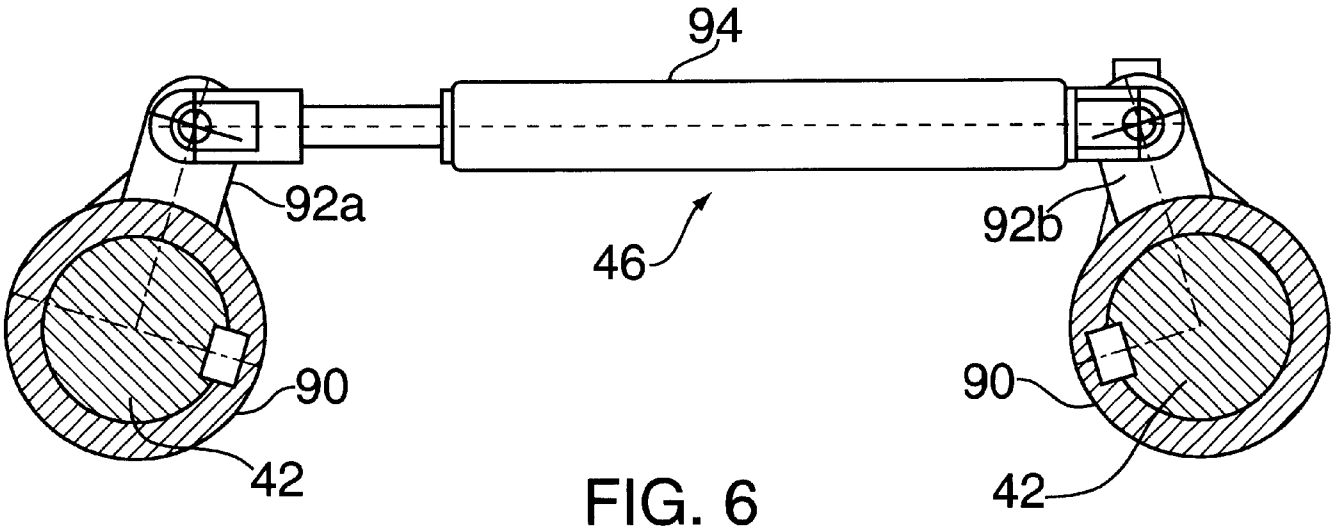
FIGS. 6 and 7 are front and top views of an eccentric bias system used in the system.
Figure 7:
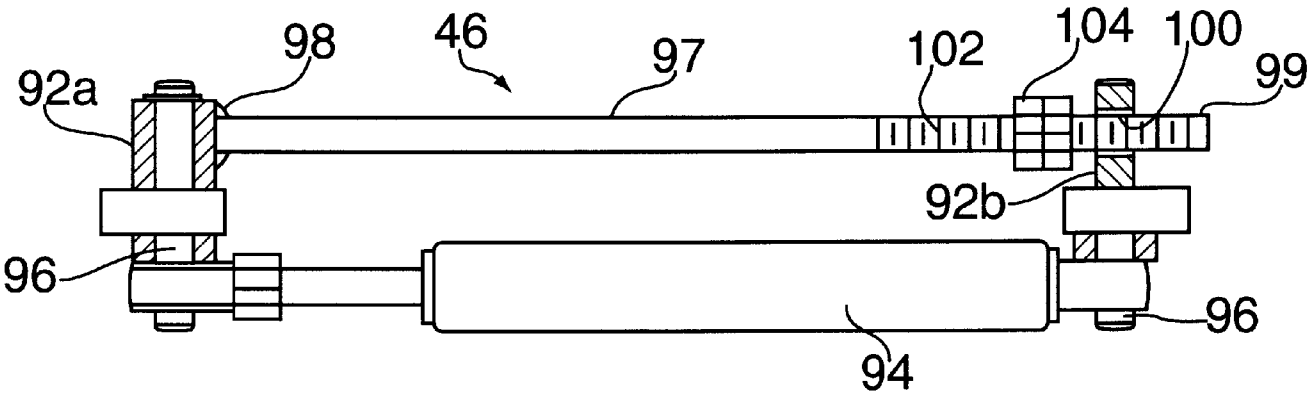

FIGS. 6–7 show in greater detail the gas spring assembly 46. A collar 90 is keyed to each of the shafts 42 on which the counter rollers 38, 40 are rotatably mounted, and includes a radially extending torque arm 92. A gas spring 94 has its opposite ends connected by pins 96 to the opposed torque arms 92*a*, 92*b*. The gas spring thus urges the two torque arms apart with a predetermined force.

In addition to the gas spring, a safety bar 97 has one end 98 fixedly connected to torque arm 92*a*. The opposite end 99 extends through a hole 100 formed in torque arm 92*b*. The opposite end 99 includes threads 102, and a pair of nuts 104.

In operation, the gas spring 94 pushes the two torque arms 92*a*, 92*b* apart, which causes the shaft 42 to rotate in its eccentric mounting, thereby urging the wheels 38 and 40 towards the traction wheel 30. The nuts 104 are adjusted so as to leave a slight clearance, e.g., about 5 mm, between the nuts 104 and the torque arm 92*b*. In this manner, during normal operation, the gas spring 94 will maintain a constant force between the wheels 38 and 40 and 30, self-adjusting for wear. Should the gas spring fail, the torque arms 92*a*, 92*b* can move apart only slightly, because after initial movement the nuts 104 will engage the torque arm 92*b*, preventing the torque arms from moving further apart. The clearance between the nuts 104 and the torque arm 92*b* should be adjusted so that, if a gas spring 94 fails, the safety bar 97 will maintain sufficient traction between the rollers and the track to move the car 10 until repairs can be effected.

Because of the fact that, in the preferred embodiment, two counterweights are used, the rails and doors are centric within the shaft, thus allowing for a smaller shaft. Also, because of the fact that the U-shaped rails are very stiff and are supported on the pit floor, the walls do not have to withstand large forces.

The foregoing represent preferred embodiments of the invention. Variations and modifications of the processes and materials disclosed herein will be apparent to persons skilled in the art, without departing from the inventive concepts disclosed herein. For example, while a preferred embodiment has been described in which a U-shaped rail is used, so as to provide track surfaces for both the traction drive wheels and the counterweight guide, it would be possible to use separate rails for the counterweights, in which case other cross-sectional shapes of rails, such as T-shaped rails or hollow rails, may be employed for the traction drive. Also, while the counterweight rope is illustrated as being attached to the car, it may instead be connected to the traction drive. Further, less than two, more than two, or different arrangements of counterweight systems may be employed. And, while the invention has been described in which both counter rollers are eccentrically mounted so as to be moveable towards the track, only one of the counter rollers needs to be moveable, and means other than eccentrics can provide such movement. All such modifications and variations are within the scope of the invention, as defined in the following claims.

I claim:

1. An elevator system comprising:

at least two landings;

a first track extending in a vertical direction between said landings;

a car;

a counterweight means, including a rope and pulley, for supporting at least a portion of the weight of said car;

a traction drive comprising at least one traction roller and a pair of counter rollers, said traction roller and said counter rollers being disposed on opposite sides of said first track, each roller having a horizontal axis, wherein the axis of said traction roller is located at vertical height which is between the axes of the counter rollers, wherein at least one of said counter rollers is moveable in a horizontal direction toward said track; means for urging said counter rollers towards said track; and drive means for selectively rotating said traction roller for moving said car between landings; and means for coupling said traction drive to said car.

2. An elevator system according to claim 1, wherein the means for urging said counter rollers towards said track comprises a gas spring.

3. An elevator system according to claim 2, wherein said at least one moveable counter roller is supported in eccentric means, and wherein said gas spring acts on said eccentric means for urging said counter roller towards said track.

4. An elevator system according to claim 3, wherein said eccentric means includes at least one torque arm, wherein said gas spring is coupled to said torque arm.

5. An elevator system according to claim 4, further comprising a safety bar coupled to said torque arm so as to permit only a predetermined amount of movement of said torque arm.

6. An elevator system according to claim 5, wherein the other of said counter rollers is supported in eccentric means so as to be moveable in a horizontal direction toward said track and includes a second torque arm, and wherein said gas spring is coupled between said torque arms, and wherein said safety bar has an end fixed to said second torque arm.

7. An elevator system according to claim 1, wherein said traction drive includes a traction drive frame which is separate from the car, and wherein said rollers and drive means are supported by the traction drive frame.

8. An elevator system according to claim 1, wherein said traction drive includes a motor, a worm gear coupled to said motor, a worm wheel engaging said worm gear, a pinion gear mounted on a common shaft with said worm wheel for rotation therewith, a spur gear engaging said pinion gear, and an output shaft coupled to said spur gear and to said traction wheel.

9. An elevator system according to claim 1, comprising a second track extending parallel to said first track, and wherein said traction drive comprises a second traction roller and a second pair of counter rollers, said second traction roller and said second pair of counter rollers being disposed on opposite sides of said second track, each roller having a horizontal axis, wherein the axis of said traction roller is located at a vertical height which is between the axes of the counter rollers of said second pair, and wherein at least one of the counter rollers of said second pair is moveable in a direction toward said track; means for urging the counter rollers of said second pair towards said track; and drive means for selectively rotating said second traction roller for moving said car between landings.

10. An elevator system according to claim 9, wherein said counterweight means includes a pair of pulleys supported respectively at an upper end of said first and second tracks, a pair of counterweights, and a pair of ropes, each rope being coupled to said car and extending over one of the pulleys to one of the counterweights.

11. An elevator system according to claim 9, comprising first and second rails disposed on opposite sides of said car, each rail having an inwardly facing, U-shaped cross-section defining a pair of parallel tracks, one track of said first rail forming said first track, and one track of said second rail forming said second track; and wherein each counterweight includes guide means for engaging one of the other tracks of said first and second rails.

* * * * *